US006519994B1

(12) United States Patent
Quambusch

(10) Patent No.: US 6,519,994 B1
(45) Date of Patent: Feb. 18, 2003

(54) ROLLING STAND WITH CROSSING BACK-UP AND/OR WORKING ROLLS

(75) Inventor: Herbert Quambusch, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/786,038

(22) PCT Filed: Mar. 2, 1999

(86) PCT No.: PCT/DE99/00628

§ 371 (c)(1),
(2), (4) Date: Jan. 28, 2001

(87) PCT Pub. No.: WO00/12236

PCT Pub. Date: Mar. 9, 2000

(30) Foreign Application Priority Data

Aug. 28, 1998 (DE) ..... 198 40 538

(51) Int. Cl.[7] ..... B21B 31/16
(52) U.S. Cl. ..... 72/237; 72/244
(58) Field of Search ..... 72/237, 245, 247, 72/244

(56) References Cited

FOREIGN PATENT DOCUMENTS

| | | | | |
|---|---|---|---|---|
| JP | 55-10339 | * 1/1980 | ..... | 72/237 |
| JP | 63-8844 | * 2/1988 | ..... | 72/247 |
| JP | 1-181908 | * 7/1989 | ..... | 72/247 |
| JP | 4-361802 | * 12/1992 | | |
| JP | 6-269812 | * 9/1994 | ..... | 72/245 |

* cited by examiner

*Primary Examiner*—Lowell A. Larson
(74) *Attorney, Agent, or Firm*—Cohen, Pontani, Lieberman & Pavane

(57) ABSTRACT

A roll stand with backup rolls and work rolls for rolling sheet and strip in which the upper and lower work rolls, together with the backup rolls associated therewith, can be displaced from the common vertical plane into positions in which the vertical planes passing through the roll axes of the work rolls and backup rolls intersect in that chocks supporting each roll within the housing window are displaced in pairs horizontally in opposite directions. Each pair of rolls formed of the upper and lower backup rolls and work rolls is received by its roll chocks in one of two cassettes extending horizontally into the housing windows located on either side of the roll housing and is guided therein such that it can be vertically and/or horizontally adjusted. The cassettes can be swiveled in opposite directions about a common central vertical axis formed by upper and lower centering pin bearings provided at the housing crosspiece and at the cassette, and each cassette is vertically supported in the area of the housing windows against the roll stand frame by articulated supports mounted on cardan joints at both ends.

21 Claims, 3 Drawing Sheets

ROLLING STAND WITH CROSSING BACK-UP AND/OR WORKING ROLLS

PRIORITY CLAIM

This is a U.S. national stage of application Ser. No. PCT/DE99/00628, filed on Mar. 02, 1999. Priority is claimed on that application and on the following application: Country: Germany, Application No.: 198 40 538.3, Filed: Aug. 28, 1998.

BACKGROUND OF THE INVENTION

The invention is directed to a roll stand with backup rolls and/or work rolls for rolling sheet and strip in which the upper and lower work rolls, possibly together with the backup rolls associated therewith, can be displaced from the common vertical plane into positions in which the vertical planes passing through the roll axes of the work rolls and backup rolls intersect in that chocks supporting each roll within the housing window are displaced in pairs horizontally in opposite directions.

Systems in which the upper and lower rolls of a four-high roll stand are swiveled in pairs and in opposite directions are also known as pair cross rolling systems. By means of the crossing of the rolls and the intersecting of the roll axes, the profile of the rolling stock can be adjusted without the need to apply high work roll bending forces as is usually required. This advantageously results in an increased bearing life.

Also, systems are known in which either only the work rolls or only the backup rolls are crossed in order to adjust or influence the required profile of the rolling stock in this way.

A great variety of solutions have been proposed for adjusting (crossing) rolls. For the chocks of the work rolls and backup rolls, European Patent Application 0 525 552 A1 suggests shared sliding blocks which are interposed between the chocks and the roll housing and which have, at their sides remote of the chocks, wedge faces corresponding to vertically adjustable displacing drives with the same wedge faces. When these displacing drives are adjusted or crossed, the wedge faces which slide one on top of the other cause a horizontal displacement of the sliding blocks so that the sliding blocks adjust the laterally contacting chocks and the rolls are crossed pairwise.

This same reference also shows other adjusting drives such as hydraulic cylinders or spindles which act mechanically on the chocks and by means of which the chock are displaced horizontally for changing the roll positions within the housing window.

In another known solution (DE 195 10 694.6) for crossing rolls, the crossing of the roll pairs is carried out by means of sliding blocks constructed as U-shaped pressure pieces whose webs contact the chocks by dome-shaped outer sides and whose legs engage around both sides of the column of the roll housing. Transverse bore holes, in which cams are mounted which are arranged at the roll housing and are rotatable relative to axes parallel to the axes of the transverse bore holes, are provided for the displacement of the pressure pieces in both legs engaging around the housing column of the roll housing.

All of these known cross rolling and pair cross rolling systems are very costly and usually require special work roll bearings; the rolls or roll sets must be provided with axial locking arrangements in order to absorb the axial forces occurring because of the inclined position of the rolls caused by the system. Another disadvantage consists in that adjusting structural component parts which impede the exchange of rolls are arranged in the area of the stand guides. Eccentrics and guides entail especially elaborate production methods.

SUMMARY OF THE INVENTION

Proceeding from a prior art such as is known from DE 195 10 694.6, it is the object of the present invention to provide a simply designed roll stand with simple displacing drives and high system stability enabling roll crossing with conventional bearings.

In order to meet this object, it is suggested according to the invention that each pair of rolls formed of the upper and lower backup rolls and work rolls is received by its roll chocks in one of two casings or cassettes extending horizontally into the housing windows located on either side of the roll housing and is guided therein such that it can be vertically and/or horizontally adjusted or crossed. The cassettes can be swiveled in opposite directions about a common central vertical axis formed by upper and lower centering pin bearings provided at the housing cross girder or crosspiece and at the cassette. Each cassette is vertically supported in the area of the housing windows against the roll stand frame by articulated supports mounted on cardan joints at both ends.

The invention is also applicable when a two-high rolling mill with only two work rolls is used. In this case, it is provided according to the invention that each work roll is received by its roll chocks in one of two cassettes extending horizontally into the housing windows located on either side of the roll housing and is guided therein such that it can be vertically and/or horizontally crossed. The cassettes can be swiveled in opposite directions about a common central vertical axis formed by upper and lower centering pin bearings provided at the housing crosspiece and at the cassette. Each cassette is vertically supported in the area of the housing windows against the roll stand frame by articulated supports mounted on cardan joints at both ends.

Further, it is also possible to use the invention in roll stands in which the work rolls are fixed against swiveling and the backup rolls can be crossed. In a rolling mill of this kind, it is provided according to the invention that each backup roll is received by its roll chocks in one of two cassettes extending horizontally into the housing windows located on either side of the roll housing and is guided therein such that it can be vertically and/or horizontally crossed. The cassettes can be swiveled in opposite directions about a common central vertical axis formed by upper and lower centering pin bearings provided at the housing crosspiece and at the cassette. Each cassette is vertically supported in the area of the housing windows against the roll stand frame by articulated supports mounted on cardan joints at both ends.

The proposed construction provides a highly effective solution with very simple mechanical equipment. Complicated crossing constructions with expensive axial bearing units are done away with in that the centric centering pin bearing support safely absorbs the large axial forces occurring from the crossing of the rolls in the cassettes because the centrally arranged centering pin does not permit any axial displacement of the cassette during swiveling. The vertical support of the cassettes on movable articulated supports makes possible the swiveling movement as well as a thermal expansion of the cassette without causing stresses in the system.

By introducing the rolling pressure into the crosspieces of the roll housings via the articulated supports, no necking results at the cassettes such as is known at the roll housings in conventional rolling mills. As a result, a tighter clearance can be selected between the chock and the guide, which means an improved and more secure guiding of the rolls.

The swiveling of the cassettes with the respective rolls and pairs of rolls received therein can be carried out in accordance with a further embodiment of the invention by means of essentially horizontally acting actuators or drives which act on the roll housings on the one hand and on the respective cassette on the other hand. Mechanical synchronizing means prevent tilting of the cassette in the roll housing. The cassettes can advantageously be clamped between hydraulic cylinders arranged on both sides, which ensures that the cassettes are guided without play.

According to another preferred solution of the invention, it is provided that the cassettes can be counterbalanced hydraulically against the upper and lower articulated supports. The lower counterbalancing serves at the same time to raise the system for changing rolls and to enable displacement of the step wedges for adjusting the pass line.

In another development according to the invention, it is provided that the hydraulic cylinders for adjusting the pair of rolls that is mounted in the upper or lower cassette so as to be vertically adjustable are installed inside the cassette together with the associated servo valves and the counterbalancing and bending cylinders for the rolls. On the one hand, the rolling forces are always introduced centrally in this way and, on the other hand, installation and disassembly of the rolls is appreciably simplified.

The cassette-type solution according to the invention allows a displacement of the work rolls in axial direction and a positive and negative work roll bending. The axial displacement of the work rolls can be achieved in a simple manner according to another feature of the invention when each work roll is displaceable in axial direction by means of a two-armed lever system whose swivel point is arranged at the cassette, one of whose lever arms is connected with a drive supported at the cassette, and whose other lever arm is connected in frictional or positive engagement with the chock of the work roll.

In order to facilitate displacement and to be able to introduce displacing forces into the chocks without torque, it is provided according to another feature of the invention that the lever arm is connected with the chock by rollers which are mounted in a rotatable manner at the end of the lever and are supported at the chock.

It is considered particularly advantageous when, according to the invention, the lever arms can be swiveled away in the area of the chocks transverse to the displacing direction of the work rolls to allow the work rolls to be disassembled.

The system according to the invention which is provided in this way enables positive and negative bending and axial displaceability of the work rolls in a simple functional device with a very large adjusting range for regulating profile and flatness. Dynamic pair crossing is possible in a simple manner without the need for elaborate and expensive swivel bearings or eccentric bearings.

An embodiment example of the invention is shown in the drawing and is described in the following.

DETAILED DESCRIPTION OF THE PREFERRED EMBODIMENTS

Figure 1:
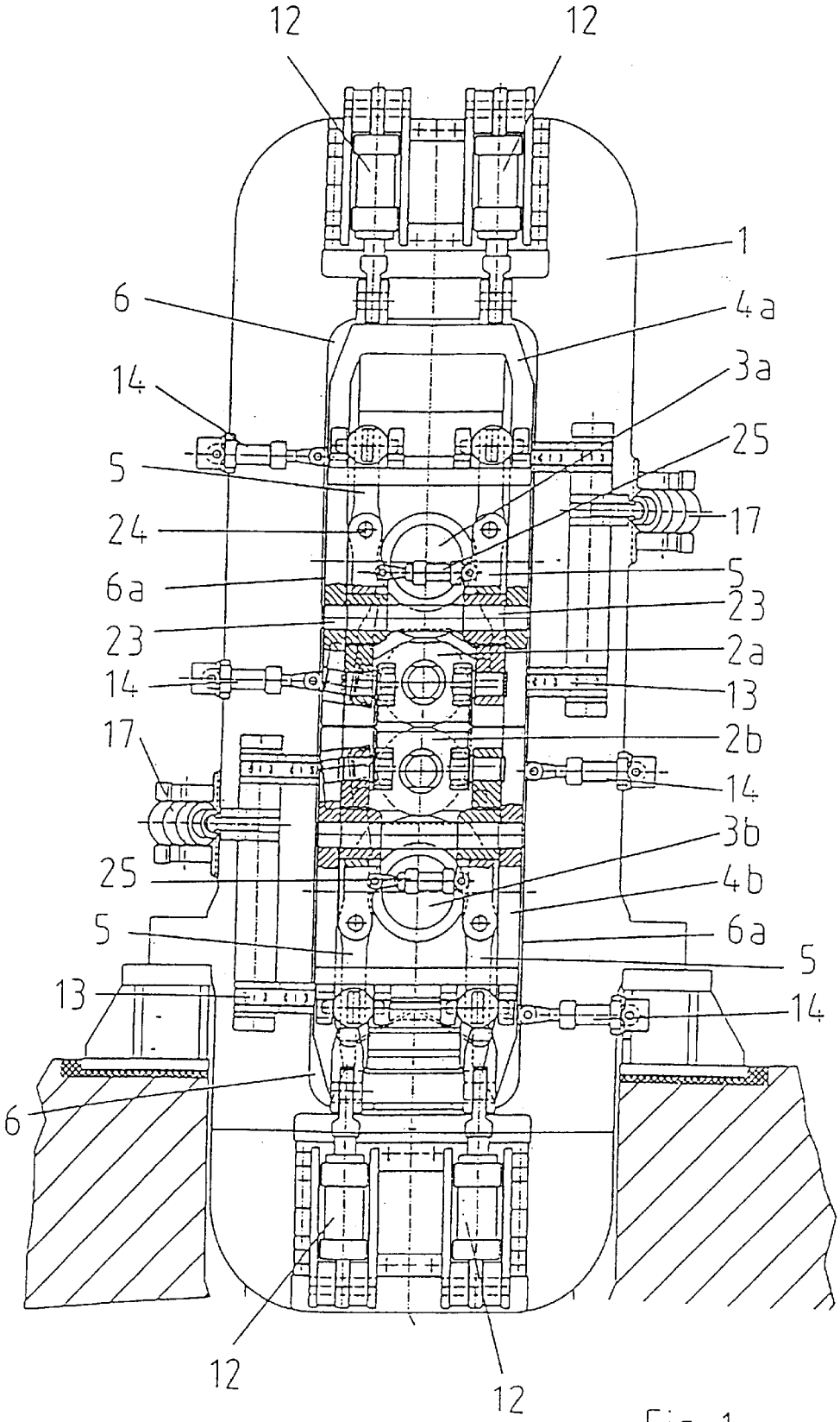
FIG. 1 shows a side view of a four-high roll stand according to the invention.

In FIG. 1, the housing of a four-high roll stand is designated by 1; its work rolls 2*a,* 2*b* and backup rolls 3*a,* 3*b* are arranged in pairs 2*a,* 3*a* and 2*b,* 3*b* in an upper cassette 4*a* and lower cassette 4*b,* respectively, so as to be guided in a vertically displaceable manner. Further, the work rolls 2*a,* 2*b* are displaceable axially, i.e., transverse to the drawing plane, by means of the double-sided lever 5.

The cassettes 4*a,* 4*b* extend transverse to the rolling plane from one side of the housing 1 to the other so as to partially enclose the pairs of rolls and extend into the housing windows 6 provided on either side of the housing 1. A clearance enabling lateral displacement of the cassettes 4*a,* 4*b* is left between the sidewalls 6*a* of each housing window 6 and the cassettes 4*a,* 4*b*.

Figure 2:
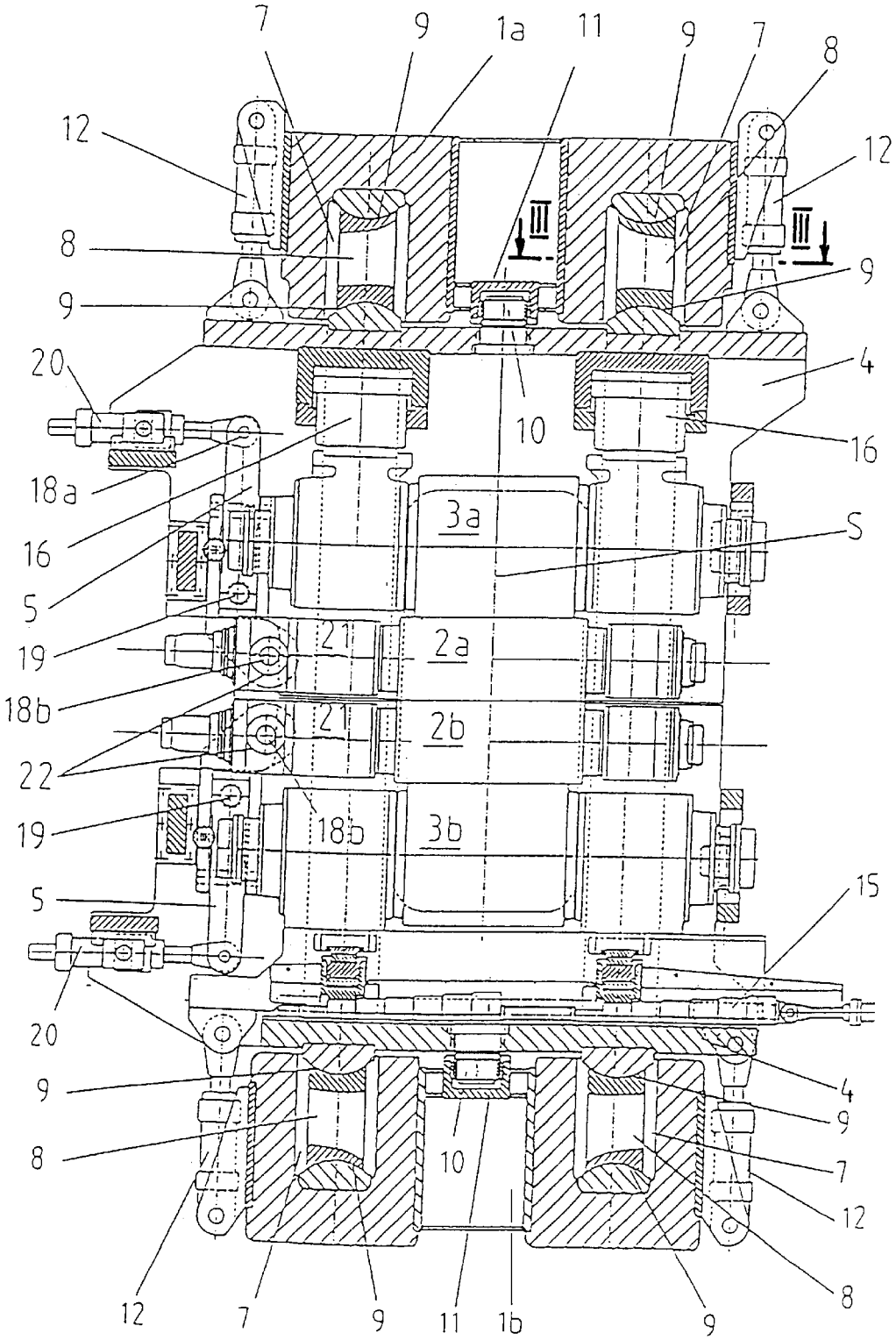
FIG. 2 shows a view of the roll stand according to FIG. 1 which is turned by 90°.
Figure 3:
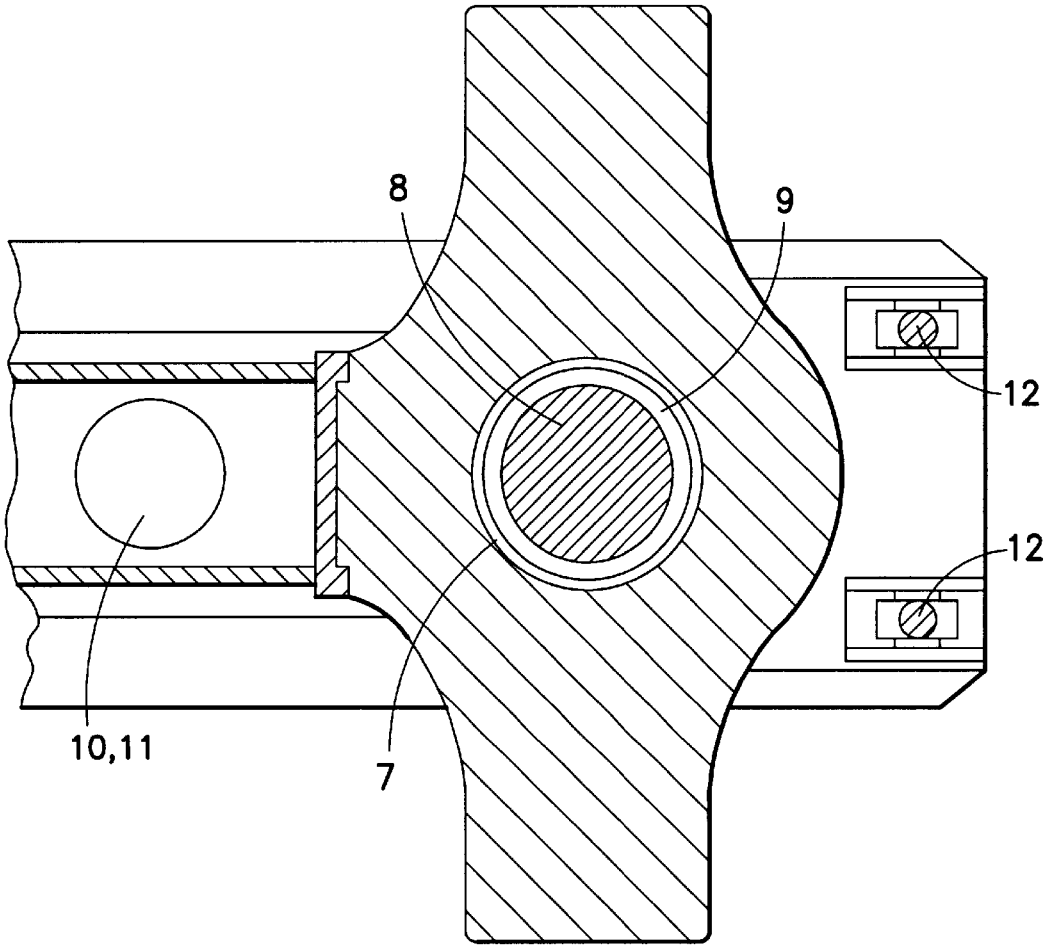
FIG. 3 shows a section III—III in FIG. 2.

The roll housing is shown in a view rotated by 90° in FIGS. 2 and 3. Provided in the area of the cross-heads 1, 1*b* of the housing 1 are recesses 7 in which the articulated support columns 8 extend approximately at right angles. The articulated support columns are mounted in cardan (i.e., universal) joints at their ends so as to allow movement in more than one plane. For this purpose, dome-shaped supporting pairs 9 are provided which enable an inclined position of the articulated support columns 8, also when loaded by rolls.

In order that the axial forces which result from the rolling forces and which occur when the pairs of rolls 2*a,* 3*a;* 3*b,* 2*b* are swiveled can be safely absorbed in a simple construction, a pin 10 extending in the vertical direction is provided in the center of the cassette 4*a* on the sides remote of the backup roll 3*a,* this pin 10 engaging in the pin bearing 11 which is arranged at the upper crosspiece of the roll stand. An identical pin 10 is arranged at the lower cassette 4*b* so as to be directed vertically downward and engages in the pin bearing 11 at the lower crosspieces 1*b* of the roll stand 1 and at the base plate. The two pins 10 are arranged in flush manner in a common vertical axis and form the swiveling axis S for the cassettes 4*a,* 4*b* when the latter are displaced or crossed in opposite directions.

The upper and lower articulated support columns 8 are interposed between the housing crosspiece 1*b* and the cassette 4*a* by means of the counterbalancing cylinder 12 acting at the cassettes 4*a,* 4*b;* the pass line adjustment (height adjustment of the system) of the lower pair of rolls is carried out in conventional manner by step wedges 15. Hydraulic cylinders 16 are installed in the upper cassette 4*a* together with the associated servo valves for adjusting the upper pair of rolls which is mounted so as to be vertically adjustable.

Mechanically (13) synchronized, horizontally adjustable hydraulic cylinders 17 which act between the housing 1 and the cassettes 4*a* and 4*b* are provided for swiveling the cassettes 4*a,* 4*b* about the pins 10. The system can be kept free of play by means of hydraulic cylinders 14 that can be pretensioned at low pressure, so that the rolling accuracy is further improved.

Each work roll 2*a,* 2*b* is displaceable in axial direction via a two-armed lever system 5 whose swivel point 19 is arranged at the respective cassette 4*a* or 4*b,* one of whose lever arms 18*a* is connected with a drive 20 supported at the cassette 4*a* or 4*b,* and whose other lever arm 18*b* is connected in frictional or positive engagement with the chock 21 of the work roll. The connection of the lever arm 18*b* with the chock 21 is carried out by means of rollers 22 which are arranged at the end of the lever 5 so as to be mounted in a rotatable manner and are supported at the respective chock 21. When the drive 20 is actuated in one direction or the other, the respective work roll 2*a* or 2*b* can be adjusted in axial direction. For disassembly of the work rolls 2*a,* 2*b,* each lever arm, as indicated in dashes at 23, can be swiveled out transverse to the chock 21 in the area of a bending joint 24 in order to move the roller 22 out of the area of the chock. For this purpose, a hydraulic cylinder 25 is arranged between the lever arms of the lever system 5 which are arranged on either side of the chocks.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A roll stand, comprising: a frame; a housing having windows and a crosspiece; roll chocks; backup rolls and work rolls supported in the roll chocks for rolling sheet and strip, the work rolls including upper and lower work rolls which, together with upper and lower of the backup rolls associated therewith, are displaceable from a common vertical plane into positions in which the vertical planes passing through roll axes of the work rolls and the backup rolls intersect in that the chocks supporting each roll within the housing window are displacable in pairs horizontally in opposite directions, each pair of rolls formed of the upper and lower backup rolls and work rolls being arranged in one of two cassettes extending horizontally into the housing windows located on either side of the roll housing and guided therein so as to be at least one of vertically and horizontally adjustable; upper and lower centering pin bearings provided at the housing crosspiece and at the cassette, the cassettes being swivelable in opposite directions about a common central vertical axis formed by the pin bearings; and upper and lower articulated support columns mounted on cardan joints at both ends, each cassette being vertically supported in the area of the housing windows against the roll stand frame by the articulated support columns.

2. A roll stand according to claim 1, and further comprising essentially horizontally acting drives operatively arranged to act on the housing and on the respective cassette for swiveling the cassettes.

3. A roll stand according to claim 1, and further comprising means for hydraulically counter-balancing the cassettes against the upper and lower articulated support columns.

4. A roll stand according to claim 3, and further comprising hydraulic cylinders for adjusting the pair of rolls that is mounted in the upper or lower cassette so as to be vertically adjustable, the hydraulic cylinders being installed inside the cassette together with associated servo valves and the counterbalancing and bending cylinders for the rolls.

5. A roll stand according to claim 1, and further comprising a two-armed lever system operatively connected to each work roll so as to axially displace the work roll, the lever system having a swivel point arranged at the cassette, a drive being connected to a first of the lever arms, the drive being supported at the cassette, a second of the lever arms being connected with a chock of the work roll.

6. A roll stand according to claim 5, wherein the second lever arm is connected with the chock by rollers which are mounted in a rotatable manner at an end of the lever arm and are supported at the chock.

7. A roll stand according to claim 5, wherein the lever arms can be swiveled transverse to a displacing direction of the work rolls into a position so as to allow the work rolls to be disassembled.

8. A roll stand for rolling sheet and strip, comprising: a frame; a housing having windows and a crosspiece; roll chocks; work rolls displacable from a common vertical plane into positions in which vertical planes passing through roll axes of the work rolls intersect in that the chocks supporting each roll within the housing window are displacable horizontally in opposite directions, each work roll being arranged in one of two cassettes extending horizontally into the housing windows located on either side of the roll housing and guided therein so as to be at least one of vertically and horizontally adjustable; upper and lower centering pin bearings provided at the housing crosspiece and at the cassette, the cassettes being swivelable in opposite directions about a common central vertical axis formed by the pin bearings; and upper and lower articulated support columns mounted on cardan joints at both ends, each cassette being vertically supported in an area of the housing windows against the roll stand frame by the articulated support columns.

9. A roll stand according to claim 8, and further comprising essentially horizontally acting drives operatively arranged to act on the housing and on the respective cassette for swiveling the cassettes.

10. A roll stand according to claim 8, and further comprising means for hydraulically counter-balancing the cassettes against the upper and lower articulated support columns.

11. A roll stand according to claim 10, and further comprising hydraulic cylinders for adjusting the pair of rolls that is mounted in the upper or lower cassette so as to be vertically adjustable, the hydraulic cylinders being installed inside the cassette together with associated servo valves and the counterbalancing and bending cylinders for the rolls.

12. A roll stand according to claim 8, and further comprising a two-armed lever system operatively connected to each work roll so as to axially displace the work roll, the lever system having a swivel point arranged at the cassette, a drive being connected to a first of the lever arms, the drive being supported at the cassette, a second of the lever arms being connected with a chock of the work roll.

13. A roll stand according to claim 12, wherein the second lever arm is connected with the chock by rollers which are mounted in a rotatable manner at an end of the lever arm and are supported at the chock.

14. A roll stand according to claim 12, wherein the lever arms can be swiveled transverse to a displacing direction of the work rolls into a position so as to allow the work rolls to be disassembled.

15. A roll stand, comprising: a frame; a housing having windows and a crosspiece; roll chocks; a pair of backup rolls; a pair of work rolls supported by the backup rolls for rolling sheet and strip, the rolls of one of the pairs of rolls being displacable from a common vertical plane into positions in which the vertical planes passing through roll axes of the rolls of the pair of rolls intersect in that the chocks supporting each roll within the housing window are displacable in pairs horizontally in opposite directions, each backup roll being received by its roll chocks in one of two cassettes extending horizontally into the housing windows located on either side of the roll housing and guided therein so as to be at least one of vertically and horizontally adjustable; upper and lower centering pin bearings provided at the housing crosspiece and at the cassette, the cassettes being swivelable in opposite directions about a common central vertical axis formed by the pin bearings; and upper and lower articulated support columns mounted on cardan joints at both ends, each cassette being vertically supported in an area of the housing windows against the roll stand frame by the articulated support columns.

16. A roll stand according to claim 15, and further comprising essentially horizontally acting drives operatively arranged to act on the housing and on the respective cassette for swiveling the cassettes.

17. A roll stand according to claim 15, and further comprising means for hydraulically counter-balancing the cassettes against the upper and lower articulated support columns.

18. A roll stand according to claim 17, and further comprising hydraulic cylinders for adjusting the pair of rolls that is mounted in the upper or lower cassette so as to be vertically adjustable, the hydraulic cylinders being installed inside the cassette together with associated servo valves and the counterbalancing and bending cylinders for the rolls.

19. A roll stand according to claim 15, and further comprising a two-armed lever system operatively connected to each work roll so as to axially displace the work roll, the lever system having a swivel point arranged at the cassette, a drive being connected to a first of the lever arms, the drive being supported at the cassette, a second of the lever arms being connected with a chock of the work roll.

20. A roll stand according to claim 19, wherein the second lever arm is connected with the chock by rollers which are mounted in a rotatable manner at an end of the lever arm and are supported at the chock.

21. A roll stand according to claim 19, wherein the lever arms can be swiveled transverse to a displacing direction of the work rolls into a position so as to allow the work rolls to be disassembled.

* * * * *